US005714082A

United States Patent [19]

Boardman et al.

[11] Patent Number: 5,714,082

[45] Date of Patent: Feb. 3, 1998

[54] AQUEOUS ANTI-SOILING COMPOSITION

[75] Inventors: Gail S. Boardman, Woodbury; Steven J. Martin, Shoreview; Aaron D. Otteson, West Lakeland Township; Jeffrey G. Linert, Woodbury; Pamela A. Wolf, West St. Paul; Roger R. Alm, Lake Elmo, all of Minn.

[73] Assignee: Minnesota Mining and Manufacturing Company, St. Paul, Minn.

[21] Appl. No.: 458,457

[22] Filed: Jun. 2, 1995

[51] Int. Cl.[6] ..... D06M 13/00; D06M 15/00

[52] U.S. Cl. ..... 252/8.62; 252/8.57; 427/389; 427/389.9; 427/391; 427/393.4; 427/394; 427/395; 427/421; 427/430.1; 427/439; 428/96; 428/289; 428/473; 428/537.5

[58] Field of Search ..... 252/8.6, 8.7, 8.75, 252/8.8, 8.57, 8.62; 427/389, 389.9, 391, 393.4, 394, 395, 421, 430.1, 439; 428/96, 289, 473, 537.5

[56] References Cited

U.S. PATENT DOCUMENTS

| | | | |
|---|---|---|---|
| 3,062,765 | 11/1962 | Sherman et al. | 524/767 |
| 3,068,187 | 12/1962 | Bolstad et al. | 524/533 |
| 3,341,497 | 9/1967 | Sherman et al. | 525/154 |
| 3,398,182 | 8/1968 | Guenthner et al. | 558/239 |
| 3,503,915 | 3/1970 | Peterson | 524/507 |
| 3,562,156 | 2/1971 | Francen | 252/8.05 |
| 3,573,952 | 4/1971 | Berger | 117/16 |
| 3,772,195 | 11/1973 | Francen | 252/8.05 |
| 3,916,053 | 10/1975 | Sherman et al. | 428/96 |
| 3,923,715 | 12/1975 | Dettre et al. | 524/199 |
| 4,001,305 | 1/1977 | Dear et al. | 554/102 |
| 4,024,178 | 5/1977 | Landucci | 560/25 |
| 4,029,585 | 6/1977 | Dettre et al. | 252/8.6 |
| 4,043,964 | 8/1977 | Sherman et al. | 524/520 |
| 4,107,055 | 8/1978 | Sukornick et al. | 252/8.6 |
| 4,147,851 | 4/1979 | Raynolds | 526/245 |
| 4,193,880 | 3/1980 | Marshall | 252/8.8 |
| 4,264,484 | 4/1981 | Patel | 524/168 |
| 4,317,859 | 3/1982 | Smith | 428/389 |
| 4,359,096 | 11/1982 | Berger | 169/44 |
| 4,401,780 | 8/1983 | Steel | 524/225 |
| 4,504,401 | 3/1985 | Matsuo et al. | 252/8.75 |
| 4,518,649 | 5/1985 | Wang et al. | 427/393.4 |
| 4,540,497 | 9/1985 | Chang et al. | 252/8.8 |
| 4,560,487 | 12/1985 | Brinkley | 252/8.75 |
| 4,595,518 | 6/1986 | Raynolds et al. | 252/8.6 |
| 4,606,737 | 8/1986 | Stern | 8/115.6 |
| 4,668,406 | 5/1987 | Chang | 252/8.75 |
| 4,792,354 | 12/1988 | Matsuo et al. | 106/2 |
| 4,795,764 | 1/1989 | Alm et al. | 521/107 |
| 4,861,501 | 8/1989 | Pfeifer | 252/8.6 |
| 4,958,039 | 9/1990 | Pechhold | 556/421 |
| 4,997,873 | 3/1991 | Süling et al. | 524/458 |
| 5,025,052 | 6/1991 | Crater et al. | 524/104 |
| 5,098,774 | 3/1992 | Chang | 428/267 |
| 5,144,069 | 9/1992 | Stern et al. | 562/556 |
| 5,153,046 | 10/1992 | Murphy | 428/96 |
| 5,207,996 | 5/1993 | Sierakowski et al. | 423/27 |
| 5,240,990 | 8/1993 | Kallfass et al. | 524/714 |
| 5,316,850 | 5/1994 | Sargent et al. | 428/378 |
| 5,410,073 | 4/1995 | Kirchner | 560/357 |

FOREIGN PATENT DOCUMENTS

| | | | |
|---|---|---|---|
| 0 172 717 | 2/1986 | European Pat. Off. | C07C 127/24 |
| 0 435 641 | 7/1991 | European Pat. Off. | C07C 275/62 |
| 0 458 356 | 11/1991 | European Pat. Off. | D06M 13/432 |
| 2 249 064 | 10/1974 | France . | |
| 58 059 278 | 4/1983 | Japan . | |
| 59 228 071 | 12/1984 | Japan . | |

OTHER PUBLICATIONS

Mason Hayek, *Waterproofing and Water/Oil Repellency*, 24 "Kirk–Othmer Encyclopedia of Chemical Technology", pp. 442–64, (3rd ed. 1979). No Month.

*Primary Examiner*—Anthony Green
*Attorney, Agent, or Firm*—John A. Burtis

[57] ABSTRACT

This invention provides compositions suitable for treating fibrous substrates to render them durably resistant to dry soil and durably repellent to water and oil. One composition is an aqueous emulsion comprising: a dry soil resistant and water and oil repellent fluorochemical treatment and an effective amount of one or more fluorochemical surfactants wherein the surfactants comprising one or two fluorochemical groups and one or two water-solubilizing polar groups. Another composition is an aqueous emulsion comprising: a dry soil resistant and water and oil repellent fluorochemical treatment; an effective amount of one or more fluorochemical surfactants wherein the surfactants comprising one or two fluorochemical groups and one or two water-solubilizing polar groups; and one or more non-fluorinated additives. A third composition is an aqueous emulsion comprising: a dry soil resistant and water and oil repellent fluorochemical treatment comprising one or more fluorine-free extender compounds, and an effective amount of one or more fluorochemical surfactants wherein the surfactants comprising one or two fluorochemical groups and one or two water-solubilizing polar groups.

36 Claims, No Drawings

AQUEOUS ANTI-SOILING COMPOSITION

FIELD OF THE INVENTION

This invention relates to the treatment of fibrous materials, particularly carpets and textiles, with fluorochemical-containing components to impart durable dry soil resistance and durable water and oil repellency thereto.

BACKGROUND OF THE INVENTION

The treatment of various fibrous substrates, most notably carpets, with fluorochemicals to render them repellent to water and oil-based stains and resistant to dry soil has been known in the art for many years. Successfully treated with these fluorochemicals, fibrous materials, including carpets, textiles, leathers, and papers, resist the discoloration that results from normal staining and soiling and keep their original aesthetic appeal. For an overview of anti-staining and anti-soiling technology, see Mason Hayek, *Waterproofing and Water/Oil Repellency*, 24 Kirk-Othmer Encyclopedia Of Chemical Technology 448–55 (3d ed. 1979).

The fluorochemicals most useful to treat carpets, textiles, leathers, and papers are fluorochemical group-containing polymers and oligomers. A wide variety of such polymeric and oligomeric fluorochemical treatments are known and described in the art. Among them are those fluorochemical ester oligomers disclosed in U.S. Pat. Nos. 3,923,715 (Dettre), 4,029,585 (Dettre), and 4,264,484 (Patel) and those fluorochemical urethane and urea oligomers disclosed in U.S. Pat. Nos. 3,398,182 (Guenthner et al.), 4,001,305 (Dear et al.), 4,792,354 (Matsuo et al.), and 5,410,073 (Kirchner). A number of other fluorochemical compositions are also used and described in the art including allophanate oligomers, biuret oligomers, carbodiimide oligomers, guanidine oligomers, oxazolidinone oligomers, and acrylate polymers. Commercial treatments of these various types are widely available and are sold, for example, under the "Scotchgard" and "Zonyl" trademarks.

Because of the general expense associated with fluorinated materials, these fluorochemical treatments are often combined with non-fluorinated extenders where those extenders do not interfere with the overall desired soil repellency and dry soil resistance of the applied product. U.S. Pat. Nos. 3,068,187 (Bolstad et al.) and 3,503,915 (Peterson et al.) describe a number of such extenders.

The incorporation of certain additives into treatment systems that include the above-mentioned fluorochemicals is also known. These additives, in some cases, may be used to improve the anti-soiling and anti-staining properties of the finished product above that obtained by use of a single fluorochemical treatment alone. For example, U.S. Pat. No. 4,861,501 (Pfeifer) describes the use of certain hydrocarbon rewetting treatments, such as sodium dioctylsulfosuccinate, with fluorochemical radical-containing polymeric water repellents to impart favorable soil and stain release properties to fibrous materials upon cleaning (i.e., release of an offending material from already stained or soiled substrate fibers without preventing the initial staining or soiling). U.S. Pat. No. 4,317,859 (Smith) describes the use of zirconium oxide with a fluorochemical repellent to improve the soil resistance of carpet yarn by promoting the retention of the fluorochemical treatment to the fiber.

Additionally, some surfactants have been used in limited circumstances as additives to carpet and textile treatments to enhance water and oil repellency and dry soil resistance over prior art materials alone. U.S. Pat. No. 4,193,880 (Marshall), for example, describes a mixture of a salt of dinonylsulfosuccinate, a salt of dimethylnaphthalene sulfonate, and ammonium perfluoroalkylcarboxylate with a fluorochemical compound consisting of polycarboxybenzene esterified with certain partially fluorinated alcohols and with hydroxyl-containing organic radicals for treating synthetic yarn to render the yarn oil repellent and soil resistant. The surfactant mixture of this composition is claimed to achieve a stable aqueous emulsion and to provide oil repellency and soil resistance. U.S. Pat. No. 4,107,055 (Sukomick, et al.) discloses the use of certain nonpolymeric fluorinated surfactants with nonhalogenated polymeric treatments having a glass transition temperature above room temperature. While the surfactant and treatment combination of this invention is claimed to provide resistance to dry soil, beneficial effects to improve water and oil repellency of the treated product are specifically disclaimed.

Fluorochemical surfactants have also been used in low concentrations as emulsifiers for aqueous dispersions of certain fluorochemical treatments. In such low concentrations, these emulsifiers themselves lend little or no benefit to the overall anti-soiling and anti-staining properties of the resulting treatment, as their inclusion is intended solely for the creation of a stable treatment dispersion. U.S. Pat. No. 4,997,873 (Süling et al.), for example, describes the use of a certain fluorochemical cationic surfactants, such as N,N,N,-trimethyl-N-perfluorooctanesulphonamidopropylammonium chloride, as emulsifiers for aqueous dispersions of fluorinated copolymers used as water- and oil-repellent finishes to textiles, leather, and paper. The total treatment system of the invention contains between 1 and 5 percent of these emulsifiers by weight relative to the amount of monomer employed for the polymerization. No additional anti-staining or anti-soiling benefit is claimed or evidenced from the presence of these emulsifiers in the overall composition.

The aforementioned state of the art treatments, while in some cases adequate for short-term water and oil repellency and dry soil resistance, lack desired durability. Many of the "harder" fluorochemical treatments, such as those with glass transition temperatures much higher than room temperature, can flake from the treated substrate when subjected to abrasion occurring during normal use. As a consequence of such behavior, these treatments can lose their ability to resist soiling of the product onto which they are applied after a relatively short period of time. U.S. Pat. No. 3,916,053 (Sherman et al.), for example, describes this limitation. Many treatments also do not completely wet the surface of a substrate when applied. As a result, the soil and stain resistant properties of these treatments can be ineffective, leaving areas of the treated substrate unprotected. In prior art formulations particularly susceptible to such processing irregularities, fluorochemical surfactants have not been evidenced to enhance the treatment's overall anti-soiling properties. See, for example, U.S. Pat. No. 5, 153,046 (Murphy).

SUMMARY OF THE INVENTION

Briefly, in one aspect, this invention provides a composition suitable for treating fibrous substrates to render them durably resistant to dry soil and durably repellent to water and oil, said composition being an aqueous emulsion comprising: a dry soil resistant and water and oil repellent fluorochemical treatment and an amount of one or more fluorochemical surfactants effective to render the treated substrate durably resistant to dry soil and durably repellent to water and oil wherein the surfactants comprising one or two fluorochemical groups and one or two water-solubilizing polar groups. In another aspect, the present invention provides a composition suitable for treating fibrous substrates to render them durably resistant to dry soil and durably repellent to water and oil, said composition being an aqueous emulsion comprising: a dry soil resistant and water and oil repellent fluorochemical treatment; an effective amount of one or more fluorochemical surfactants wherein the surfactants comprising one or two fluorochemical groups and one or two water-solubilizing polar groups; and one or more non-fluorinated additives. In yet another aspect, the present invention provides a composition suitable for treating fibrous substrates to render them durably resistant to dry soil and durably repellent to water and oil, said composition being an aqueous emulsion comprising: a dry soil resistant and water and oil repellent fluorochemical treatment comprising one or more fluorine-free extender compounds, and an effective amount of one or more fluorochemical surfactants wherein the surfactants comprising one or two fluorochemical groups and one or two water-solubilizing polar groups.

The present invention also provides a method of treating fibrous substrates with the aforementioned compositions to render them durably resistant to dry soil and durably repellent to water and oil. This invention further provides durably dry soil resistant and durably water and oil repellent fibrous substrate articles.

DETAILED DESCRIPTION OF INVENTION

Generally, the fluorochemical treatments useful in the present invention include any of the fluorochemical radical-containing polymeric and oligomeric compounds known in the art to impart dry soil resistance and water- and oil-repellency to fibrous substrates, particularly to carpet. These polymeric and oligomeric fluorochemical treatments typically comprise one or more fluorochemical radicals that contain a perfluorinated carbon chain having from 3 to about 20 carbon atoms, more preferably from about 6 to about 14 carbon atoms. These fluorochemical radicals can contain straight chain, branched chain, or cyclic fluorinated alkylene groups or any combination thereof. The fluorochemical radicals are preferably free of polymerizable olefinic unsaturation but can optionally contain catenary heteroatoms such as oxygen, divalent or hexavalent sulfur, or nitrogen. Fully fluorinated radicals are preferred, but hydrogen or chlorine atoms may also be present as substituents provided no more than one atom of either is present for every two carbon atoms. It is additionally preferred that any fluorochemical radical contain from about 40% to about 80% fluorine by weight, more preferably about 50% to about 78% fluorine by weight. The terminal portion of the radical must be fully fluorinated, preferably containing at least 7 fluorine atoms, e.g., $CF_3CF_2CF_2$—, $(CF_3)_2CF$—, $SF_5CF_2$—. Perfluorinated aliphatic groups (i.e., those of the formula $C_nF_{2n+1}$—) are the most preferred fluorochemical radical embodiments.

Representative fluorochemical compounds useful as treatments in the present invention include fluorochemical urethanes, ureas, esters, ethers, alcohols, epoxides, allophanates, amides, amines (and salts thereof), acids (and salts thereof), carbodiimides, guanidines, oxazolidinones, isocyanurates, and biurets. Blends of these compounds are also considered useful. Representative fluorochemical radical-containing polymers useful as treatments in the present invention include fluorochemical acrylate and substituted acrylate homopolymers and copolymers containing fluorochemical acrylate monomers interpolymerized with monomers free of vinylic fluorine such as methyl methacrylate, butyl acrylate, octadecylmethacrylate, acrylate and methacrylate esters of oxyalkylene and polyoxyalkylene polyol oligomers (e.g., oxyethylene glycol dimethacrylate, polyoxyethylene glycol dimethacrylate, methoxy acrylate, and polyoxyethylene acrylate), glycidyl methacrylate, ethylene, butadiene, styrene, isoprene, chloroprene, vinyl acetate, vinyl chloride, vinylidene chloride, vinylidene fluoride, acrylonitrile, vinyl chloroacetate, vinylpyridine, vinyl alkyl ethers, vinyl alkyl ketones, acrylic acid, methacrylic acid, 2-hydroxyethylacrylate, N-methylolacrylamide, 2-(N,N,N-trimethylammonium)ethyl methacrylate, and 2-acrylamido-2-methylpropanesulfonic acid (AMPS). The relative amounts of various vinylic fluorine-free comonomers used are generally selected empirically depending on the fibrous substrate to be treated, the properties desired, and the mode of application onto the fibrous substrate. Useful fluorochemical treatments also include blends of the various fluorochemical compounds described above.

Also useful in the present invention as substrate treatments are blends of these fluorochemical compounds with fluorine-free extender compounds, such as siloxanes, acrylate and substituted acrylate polymers and copolymers, N-methylolacrylamide-containing acrylate polymers, urethanes, blocked isocyanate-containing polymers and oligomers, condensates or precondensates of urea or melamine with formaldehyde, glyoxal resins, condensates of fatty acids with melamine or urea derivatives, condensation of fatty acids with polyamides and their epichlorohydrin adducts, waxes, polyethylene, chlorinated polyethylene, alkyl ketene dimers, esters, and amides. Blends of the these fluorine-free extender compounds are also considered useful in the present invention. The relative amount of the extender compounds in the treatment is not critical to the present invention. However, the overall composition of the fluorochemical treatment should contain, relative to the amount of solids present in the system, at least 3 weight percent, preferably at least about 5 weight percent, carbon-bound fluorine in the form of said fluorochemical radical groups. Many treatments, including treatment blends that include fluorine-free extender molecules such as those described above, are commercially available as ready-made formulations. Such products are sold, for example, as Scotchgard™ brand Carpet Protector manufactured by 3M Co., Saint Paul, Minn., and as Zonyl™ brand carpet treatment manufactured by E.I. du Pont de Nemours and Company, Wilmington, Del.

The fluorochemical surfactants useful in the present invention are those containing one or two fluorochemical groups and one or two water-solubilizing polar groups, usually connected together by a suitable linking group. The particular structure of the fluorochemical surfactant is not critical; rather, the balance of the physical properties of the compound determines its usefulness for the purpose of this invention. The fluorochemical surfactant should have a solubility in water at 25° C. of at least 0.01% by weight, preferably at least 0.25% by weight.

Many of the fluorochemical surfactants useful in the present invention may be represented by the following general formula:

$$(R_f)_n(Q)_x(Z)_m$$

wherein n is 1 or 2, x is 0 or 1, m is 1 or 2, and $R_f$ is a fluorochemical group identical to that defined earlier for the fluorochemical treatment except that most preferably $R_f$ for the fluorochemical surfactant contains only from about 1 to about 12 carbon atoms. The composition of the fluorochemical surfactant should contain, relative to the amount of surfactant solids, at least 5 weight percent, preferably at least about 20 weight percent, of carbon-bound fluorine in the form of said $R_f$ group or groups.

Z is a water-solubilizing polar group containing an anionic, cationic, nonionic or amphoteric moiety or any combination thereof. Typical anionic Z groups include $CO_2H$, $CO_2M$, $SO_3H$, $SO_3M$, $OSO_3H$, $OSO_3M$, $OPO(OH)_2$, and $OPO(OM)_2$, wherein M is a metallic ion, such as sodium, potassium or calcium, or is ammonium or another such nitrogen-based cation. Typical cationic Z groups include $NH_2$, NHR, wherein R is a lower alkyl group, and $NR'_3A'$, where R' is a lower alkyl group or hydrogen and A' is an anion such as chloride, iodide, sulfate, phosphate, or hydroxide. Representative nonionic Z groups include polyoxyethylenes (e.g., $O(CH_2CH_2O)_7CH_3$ and $O(CH_2CH_2O)_{14}H$), and mixed polyoxyethylene/polyoxypropylene alcohols and polyols. Typical amphoteric Z groups include $N^+(CH_3)_2O^-$, $N^+(CH_3)_2CH_2CH_2COO^-$ and $N^+(CH_3)_2CH_2CH_2CH_2SO_3^-$.

Q is a multivalent, generally divalent, linking group such as an alkylene (e.g., ethylene), an arylene (e.g., phenylene), a combination of an alkylene and an arylene (e.g., xylylene), an oxydialkylene (e.g., $CH_2CH_2OCH_2CH_2$), a thiodialkylene (e.g., $CH_2CH_2SCH_2CH_2$), a sulfonamidoalkylene (e.g., $SO_2N(CH_2CH_3)CH_2CH_2$), a carbonamidoalkylene (e.g., $CONHCH_2CH_2CH_2$), or a sulfonamidodialkylene (e.g., $CH_2CH_2SO_2NHCH_2CH_2$). The Q groups for a specific surfactant will depend upon the specific reactants used in its preparation. In some instances, more than one fluorochemical radical may be attached to Q and, in other instances, a single fluorochemical radical may be attached by a single linking group to more than one polar solubilizing group. For the particular case where x is 0, Q is absent and $R_f$ is covalently bonded to Z which will often be the case when Z is $SO_3M$ or $CO_2M$.

Additional useful fluorochemical surfactants are those disclosed in U.S. Pat. Nos. 3,562,156 (Francen), 3,772,195 (Francen), 4,359,096 (Berger) and 4,795,764 (Alm et al.), whose descriptions are incorporated herein by reference. Representative fluorochemical surfactants useful in this invention include the following individually listed compounds and mixtures thereof:

$C_7F_{15}CO_2^-N(C_2H_5)_4^+$ $C_7F_{15}CO_2^-N(C_4H_9)_4^+$ $(CF_3)_2CF(CF_2)_6COO^-H_3N^+C_2H_5$ $C_7F_{15}CO_2^-H_3N^+C_3H_6N^+(CH_3)_2C_2H_4COO^-$ $C_7F_{15}CO_2^-H_3N^+CH_2COO^-Na^+$ $C_8F_{17}C_2H_4SC_2H_4N(CH_3)CH_2COO^-Li^+$ $C_8F_{17}SO_2N(C_2H_5)CH_2COO^-K^+$ $C_5F_{11}O(CF_2)_5COOH$ $C_8F_{17}SO_3^-K^+$ $C_8F_{17}SO_3^-(C_4H_9)_4N^+$ $(C_8F_{17}SO_3^-)_2Ca^{+2}$ $C_{10}F_{21}SO_3^-NH_4^+$ $C_8F_{17}SO_2NHCH_2C_6H_4SO_3^-Na^+$ $H(CF_2)_{10}OC_6H_4SO_3^-Na^+$ $C_8F_{17}SO_2NHC_3H_6N(CH_3)C_3H_6SO_3^-Na^+$ $C_8F_{17}SO_2C_2H_4SC_2H_4CONHC(CH_3)_2CH_2SO_3^-Na^+$ $C_7F_{15}CONHC_3H_6N(CH_3)C_3H_6SO_3^-Na^+$ $2(C_8F_{17}SO_3^-)H_3N^+CH(CH_3)CH_2[OCH(CH_3)CH_2]_a[OCH_2CH_2]_b—[OCH_2CH(CH_3)]_cOCH_2CH(CH_3)NH_3^+$ $C_8F_{17}SO_2N(C_2H_5)C_2H_4OP(O)(OH)_2$ $C_8F_{17}C_2H_4OP(O)(O^-)_2(H_4N^+)_2$ $C_8F_{17}SO_2N(H)C_3H_6N^+(CH_3)_3I^-$ $C_6F_{13}SO_2NHC_3H_6N^+(CH_3)_3Cl^-$ $C_8F_{17}C_2H_4SC_2H_4N^+(CH_3)_3CH_3OSO_3^-$ $C_8F_{17}C_2H_4SC_2H_4CONHC_2H_4N^+(CH_3)_3Cl^-$ $C_6F_{13}SO_2N[CH_2CH(OH)CH_2SO_3^-]C_3H_6N^+(CH_3)_2C_2H_4OH$ $C_6F_{13}SO_2N(C_3H_6SO_3^-)C_3H_6N^+(CH_3)_2C_2H_4OH$ $C_6F_{13}SO_2N(C_3H_6SO_3^-)C_3H_6N^+(CH_3)_2H$ $C_6F_{13}SO_2N(C_2H_4CO_2^-)C_3H_6N^+(CH_3)_2H$ $C_6F_{13}C_2H_4SO_2N(CH_3)C_2H_4N^+(CH_3)_2C_2H_4COO^-$ $C_8F_{17}SO_2NHC_3H_6N^+(CH_3)_2O^-$ $C_6F_{13}SO_2N(C_2H_4OH)C_3H_6N(CH_3)_2$ $C_8F_{17}C_2H_4SC_2H_4CONH_2$ $C_8F_{17}SO_2N(C_2H_5)C_2H_4O(C_2H_4O)_{13}H$ $C_8F_{17}SO_2N(C_2H_5)C_2H_4O(C_2H_4O)_{6.2}CH_3$ $C_8F_{17}C_2H_4O(C_2H_4O)_{10}H$

The fluorochemical surfactants of the present invention may optionally be blended with one or more non-fluorinated additives. These non-fluorinated additives include any of the non-fluorinated compounds known in the art to provide an anti-soiling effect when applied to carpet with a suitable fluorochemical agent. Such compounds include, for example, hydrocarbon surfactants such as water soluble sulfonates of succinic esters, particularly sodium dioctylsulfosuccinate (DOSS), branched and linear alcoholic ethoxylates, alkylated alkynyl diols, polyethoxylated siloxanes, and alkyl, alkylether and alkylaryl sulfates, sulfonates and their corresponding acids. Non-fluorinated additives useful in this invention also include hydrophilic anti-staining compounds such as acrylic and methacrylic acid polymers and copolymers, sulfonated phenol-formaldehyde resins, and styrene-maleic anhydride polymers. Blends of these compounds are also considered useful. Additional non-fluorinated compounds suitable for use in the present invention include those sulfonated novolak resin compositions described by U.S. Pat. Nos. 5,098,774 (Chang), whose description is incorporated herein by reference and those compounds described by U.S. Pat. No. 5,316,850 (Sargent et al.) whose description is also incorporated herein by reference. Commercially available non-fluorinated additives suitable for combination with the fluorochemical surfactants of this invention include the following: Aerosol™ OT Surfactant available from Rohm & Haas Corp.; Surfynol™ Surfactant 440 available from Air Products, Inc.; Synthrapol™ KB Surfactant available from ICI Americas Corp.; Silwet™ Surfactant L-77 available from Union Carbide Corp.; Witco™ Surfactant 1298, available from Witco Corp.; and Siponate™ Surfactant DS-10, available from Rhone-Poulenc, Inc.

The complete composition suitable for treating a fibrous substrate may be prepared by combining the surfactants or surfactant mixtures of this invention with an aqueous emulsion of a suitable polymeric or oligomeric fluorochemical treatment. Forming the treatment emulsion may require using one or more emulsifiers compatible with the particular chosen treatment. The fluorochemical surfactant or surfactants should be blended with the chosen fluorochemical treatment or treatments such that the fluorochemical surfactants comprises greater than 5 percent by weight, preferably greater than 10 percent, of the blend relative to the weight of the treatment. The concentration of the fluorinated surfactant within the complete aqueous composition should be greater than approximately 0.02 weight percent of the composition. Preferably, the surfactant concentration in the aqueous composition is between approximately 0.1 and 0.25 weight percent. The concentration of fluorochemical treatment in the aqueous composition should be between approximately 0.5 and 10 weight percent, the upper limit being bound by processing constraints and economic considerations.

The aqueous composition containing the surfactant or surfactant mixture and a fluorinated treatment may be applied to a fibrous substrate using any state of the art application method. Typically, the composition will be applied by spraying directly and evenly onto either the dry or the prewet substrate, by immersing (e.g. padding) the substrate into the composition, or by foam application of the composition onto the substrate. Spray application is the preferred method of application for use in accordance with this invention. The treatment is usually then also heat cured by drying the treated substrate in an oven for between about 10 to about 40 minutes at an elevated temperature, typically between 200° F. and 300° F. The concentration of the fluorinated treatment within the complete aqueous composition of this invention may be independently chosen to yield a desired concentration of treatment on the finished substrate given a choice of the above processing parameters, e.g. roller speed, drying capacity, et cetera.

The following examples are offered to aid in a better understanding of the present invention. These examples present and evaluate a number of useful treatments and surfactants according to the general formulas previously defined. The following listed examples are not to be construed as an exhaustive compilation of all surfactants and treatments useful in the present invention and the examples are not to be unnecessarily construed as limiting the scope thereof.

EXAMPLES

FLUOROCHEMICAL SURFACTANTS (FCS) EVALUATED

FCS-1: $C_7F_{15}CO_2^-N(C_4H_9)_4^+$, can be prepared by mixing 649.8 g (1 mole) of a 40% aqueous solution of tetrabutylammonium hydroxide (available as Catalog No. 17,878-0 from Aldrich Chemical Co.) with 407.2 g of isopropyl alcohol (IPA) and adding 414 g of $C_7F_{15}COOH$ (available from 3M Co. as Fluorad™ Fluorochemical Acid FC-26). The acid can be added rapidly though the reaction is slightly exothermic. The resulting surfactant solution comprises by weight 45% solids, 27.5% IPA and 27.5% water.

FCS-2: $C_8F_{17}SO_3^-K^+$, is available from 3M Co. as Fluorad™ Fluorochemical Surfactant FC-95, a 100% active solid.

FCS-3: $C_8F_{17}SO_2N(C_2H_5)CH_2CO_2^-K^+$, is available from 3M Co. as Fluorad™ Fluorochemical Surfactant FC-129, a 50% (wt) active solution in ethylene glycol monobutyl ether/water.

FCS-4: $C_6F_{13}SO_2N(CH_2CH_2CO_2^-)CH_2CH_2CH_2N^+(CH_3)_2H$, can be prepared using the procedure described in U.S. Pat. No. 5,144,069, Example 1.

FCS-5: $C_8F_{17}SO_2N(H)C_3H_6N^+(CH_3)_3I^-$, is available from 3M Co. as Fluorad™ Fluorochemical Surfactant FC-135, a 50% (wt) active solution in isopropyl alcohol/water.

FCS-6: $C_7F_{15}CO_2^-N(C_2H_5)_4^+$, can be prepared using the same procedure as described in the synthesis of FCS-1 except that 1 mole of 40% aqueous tetraethylammonium hydroxide (available as Catalogue No. 30,292-9 from Aldrich Chemical Co.) is used in place of 1 mole of 40% aqueous tetrabutylammonium hydroxide.

FCS-7: $C_{10}F_{21}SO_3^-NH_4^+$, is available from 3M Co. as Fluorad™ Fluorochemical Surfactant FC-120, a 25% (wt) active solution in ethylene glycol monobutyl ether/water.

FCS-8: $(C_8F_{17}SO_3^-)_2Ca^{+2}$, can be prepared by adding with stirring a 25% aqueous solution of calcium oxide (prepared from 2.8 g calcium oxide and 8.4 g deionized water) to a solution of 50 g of $C_8F_{17}SO_3H$ in isopropyl ether. The solution is stirred for an additional two hours and the product was stored.

FCS-9: $C_6F_{13}SO_2N[CH_2CH(OH)CH_2SO_3]CH_2CH_2CH_2N^+(CH_3)_2CH_2CH_2OH$, can be prepared as described in U.S. Pat. No. 5,207,996, Example 1.

FCS-10: $C_8F_{17}SO_2N(C_2H_5)\ C_2H_4O(C_2H_4O)_{13}H$, is available from 3M Co. as Fluorad™ Fluorochemical Surfactant FC-170C, a 100% active liquid.

FCS-11: $C_8F_{17}SO_2N(C_2H_5)C_2H_4O(C_2H_4O)_{6.2}CH_3$, is available from 3M Co. as Fluorad™ Fluorochemical Surfactant FC-171, a 100% active liquid.

FCS-12: $C_7F_{15}COOH$, is available from 3M Co. as Fluorad™ Fluorochemical Acid FC-26, a 100% active solid.

FCS-13: $C_2F_5$-c-$C_6F_{10}SO_3^-K^+$, is available from 3M Co. as Fluorad™ Fluorochemical Surfactant FC-98, a 100% active solid.

FCS-14: Zonyl™ FSJ Fluorosurfactant, believed to be a 40% active solution in isopropyl alcohol/water of a diammonium tetrahydrofluorinated alkyl phosphate, is available from DuPont Corp.

FCS-15: Zonyl™ FSE Fluorosurfactant, believed to be a 14% active solution in water/ethylene glycol of tetrahydro fluorinated alkyl phosphate ammonium salts, is available from DuPont Corp.

FCS-16: Zonyl™ NF Fluorosurfactant, believed to be a 20% active aqueous solution of tetrahydro fluorinated alkyl phosphate ammonium salts, is available from DuPont Corp.

FCS-17: Zonyl™ FSN-100 Fluorosurfactant, believed to be a 100% active liquid of tetrahydro fluorinated alkyl ethoxylate (CAS No. 65545-80-4), is available from DuPont Corp.

FCS-18: $CF_3SO_3^-Li^+$, is available from 3M Co. as Fluorad™ Lithium Trifluoromethanesulfonate FC-122, a 100% active solid.

FCS-19: A 30/70 (wt %) copolymer of $C_8F_{17}SO_2N(C_4H_9)C_2H_4OCOCH{=}CH_2$ and $HO(C_2H_4O)_{10}(C_3H_6O)_{22}(C_2H_4O)_{10}COCH{=}CH_2$, can be prepared using the procedure described in U.S. Pat. No. 3,787,351, Example 1.

HYDROCARBON AND SILICONE SURFACTANTS (HSS) EVALUATED

HSS-1: $C_8H_{17}OC(O)CH(SO_3^-Na^+)CH2C(O)OC_8H_{17}$) (dioctylsodium sulfosuccinate), often referred to as "DOSS," is available from Rohm & Haas Co. as Aerosol™ OT Surfactant, a 100% active solid.

HSS-2: Ethoxylated (3.5 moles) tetramethyl decynediol, is available from Air Products and Chemicals, Inc. as Suffynol™ Surfactant 440, a 100% active solid.

HSS-3: Synthrapol™ KB Surfactant, believed to be an ethylene oxide condensate of an aliphatic alcohol, is available from ICI Americas Corp. as a 96% active liquid.

HSS-4: Silwet™ Silicone Glycol Copolymer L-77, is available from Union carbide Corp. as a 100% active liquid.

HSS-5: Sodium Xylenesulfonate, $(CH_3)_2C_6H_3SO_3^-Na^+$, is available as Catalog No. 24,253-5 from Aldrich Chemical Co. as a 40% (wt) solution in water.

FLUOROCHEMICAL TREATMENTS (FCT) EVALUATED

FCT-1: Scotchgard™ Commercial Carpet Protector FX-1373M, a 31.1% (wt) solids aqueous treatment containing a fluorochemical urethane, is available from 3M Company. The active ingredient in this product is emulsified in water with Siponate™ Surfactant DS-10, a 100% solids anionic emulsifier which is sodium dodecylbenzenesulfonate (available from Rhone-Poulenc, Inc.).

FCT-2: This aqueous treatment contains the same fluorochemical urethane as FCT-1 but is 16.7% (wt) solids and, instead of Siponate™ Surfactant DS-10, contains Varine™ Surfactant, believed to be 100% active cocohydroxyethyl imidazoline (available from Sherex Chem. Co.) as a cationic emulsifier.

FCT-3: A fluorochemical urethane-based aqueous treatment was made using the following procedure:

To a 3-neck round bottom flask equipped with an overhead stirrer, reflux condensor and nitrogen inlet was added 58.2 g of Desmodur™ Isocyanate N-3300 (a trifunctional isocyanate biuret derived from three moles of 1,6-hexamethylene diisocyanate and water, available from Miles Corp.), 142 g of $C_8F_{17}SO_2N(CH_3)CH_2CH_2OH$, 200 g of methyl isobutyl ketone (MIBK) and 3 drops of stannous octoate catalyst. The mixture was refluxed until the fluorochemical alcohol was consumed as measured by gas phase chromatography (GPC) (theoretically consuming 85% of the available isocyanate groups). Then 1.4 g of ethylene glycol and 2 additional drops of stannous octoate were added and the mixture was refluxed again until no isocyanate groups remained as monitored by Fourier transform infra-red analysis (FTIR).

A surfactant solution was made by heating and mixing 11 g of Siponate™ Surfactant DS-10 with 475 g of deionized water. This hot aqueous surfactant solution was then added with stirring to the solution of fluorochemical urethane in MIBK, and the resulting emulsion was subjected to ultrasonic radiation using a Branson Sonifier™ Untrasonic Horn 450 (available from VWR Scientific). The MIBK solvent was removed under reduced pressure to yield the desired fluorochemical urethane aqueous emulsion, which contained 29.5% (wt) solids.

FCT-4: Duratech carpet protector, an aqueous fluorochemical polymer carpet treatment containing 30.0% (wt) solids, is available from DuPont Corp.

FCT-5: Scotchgard™ Commercial Carpet Protector FC-1355, an aqueous fluoroaliphatic polymer treatment containing 45.6% (wt) solids, is available from 3M Company.

FCT-6: Scotchgard™ Commercial Carpet Protector FX-358, an aqueous fluoroalkyl polymer treatment containing 41.4% solids, is available from 3M Company.

FCT-7: A fluorochemical acrylic-based aqueous copolymer treatment was made using the following procedure:

To a reaction bottle was added 32.5 g of $C_8F_{17}SO_2N(CH_3)C_2H_4OOCC(CH_3)=CH_2$, 17.5 g of octadecyl methacrylate, 75 g of ethyl acetate, 75 g of heptane and 0.5 g of 2,2'-azobisisobutyronitrile (AIBN) initiator. The mixture was degassed using reduced pressure and a nitrogen purge and the bottle was placed in a laundrometer at 65° C. for 16 hours. The bottle was then removed from the laundrometer and the polymer solution in the bottle was emulsified by mixing with it 200 g of a hot solution of 2.5 g of Siponate™ Surfactant DS-10 in deionized water followed by ultrasonic irradiation. The solvents were then removed by stripping under reduced pressure to provide an aqueous fluorochemical emulsion of 21% (wt) solids.

FCT-8: A fluorochemical acrylic-based aqueous terpolymer treatment was made using the following procedure:

To a reaction bottle was added 32.5 g of $C_8F_{17}SO_2N(CH_3)C_2H_4OCOOC(CH_3)=CH_2$, 8.75 g of methyl methacrylate, 8.75 g of ethyl methacrylate, 75 g of ethyl acetate, 75 g of heptane and 0.5 g of 2,2'-azobisisobutyronitrile (AIBN) initiator. The mixture was degassed using reduced pressure and a nitrogen purge and the bottle was placed in a laundrometer at 65° C. for 16 hours. The bottle was then removed from the laundrometer and the polymer solution in the bottle was emulsified by mixing with it 200 g of a hot solution of 2.5 g of Siponate™ Surfactant DS-10 in deionized water followed by ultrasonic irradiation. The solvents were then removed by stripping under reduced pressure to provide an aqueous fluorochemical emulsion of 19.9% (wt) solids.

HYDROCARBON TREATMENTS (HCT) EVALUATED

HCT-1: A cationically emulsified aqueous hydrocarbon treatment of the type described in U.S. Pat. No. 4,107,055 was made using the following procedure:

To a reaction bottle was added 49.25 g methyl methacrylate, 1.56 g of a 48% aqueous solution of N-methylolacrylamide, 2.5 g of cetyltrimethylammonium bromide, 0.5 g of AIBN initiator, and 200 g of deionized water. The mixture was degassed using reduced pressure and a nitrogen purge and the bottle was placed in a laundrometer at 65° C. for 16 hours. Following the polymerization, the contents of the reaction bottle were poured into a storage jar. The resulting emulsion contained 24.1% (wt) solids.

HCT-2: An anionically emulsified aqueous hydrocarbon treatment of the type described in U.S. Pat. No. 4,107,055 was made using the same procedure as described for the preparation of HCT-1 except that 2.5 g of Siponate™ Surfactant DS-10 was substituted for the 2.5 g of cetyltrimethylammonium bromide. The resulting emulsion contained 25.4% (wt) solids HCT-3: A hydrocarbon urethane extender was made using the following procedure:

To a 3-neck round bottom flask equipped with an overhead stirrer, reflux condensor and nitrogen inlet was added 57.3 g of Desmodur™ Isocyanate N-100 (a trifunctional isocyanate biuret derived from three moles of 1,6-hexamethylene diisocyanate and water, available from Miles Corp.), 82 g of $C_{18}H_{37}OH$, 200 g of methyl isobutyl ketone (MIBK) and 3 drops of stannous octoate catalyst. The mixture was refluxed with stirring until no isocyanate groups remained as monitored by FTIR.

A surfactant solution was made by heating and mixing 8 g of Siponate™ Surfactant DS-10 with 470 g of deionized water. This hot aqueous surfactant solution was then added with stirring to the solution of hydrocarbon urethane in MIBK, and the resulting emulsion was subjected to ultrasonic irradiation. The MIBK solvent was removed under reduced pressure to yield the desired hydrocarbon urethane aqueous emulsion, which contained 21.8% (wt) solids.

Examples 1–4

In Examples 1–4, a formulation containing FCT-1 fluorochemical urethane treatment and FCS-1 fluorochemical carboxylate surfactant was coapplied to carpet by spraying and padding, and the carpet was subsequently cured for 15 minutes at 250° F. (121° C.). The carpet used was a commercial light blue nylon 6,6 carpet having a face weight of 36 oz/yd$^2$ (1.2 kg/m$^2$).

Spray application was accomplished using a laboratory-sized spray booth which was designed to mimic the performance of a large-scale commercial spray boom as is conventionally used in carpet mills. The application rate was controlled by varying the conveyor speed (to control the desired SOF levels). Typical wet pick-up for this carpet using spray application was approximately 10% based on the dry carpet weight.

The padding process consisted of immersing the carpet sample in the padding solution, agitating or squeezing the carpet to insure complete and even saturation, and subsequently passing the saturated carpet through the nip of the padder to express excess solution. The amount of liquid expressed was controlled by either changing the force between the nip rolls or by changing roller speed. Typical percent wet pick-up for carpet using pad application was approximately 70% based on the dry carpet weight.

Knowing the desired treatment and surfactant solids-on-fiber (SOF) add-on level (weight percent) and the amount of wet pickup occurring at a particular conveyor or roller speed, aqueous solutions for application were prepared by adding the appropriate amount of FCT-1 and FCS-1 to deionized water and stirring each solution by hand to disperse the fluorochemical treatment and surfactant. For each of Examples 1–4, FCT-1 was applied to the carpet at 0.14% SOF. In Examples 1 and 3, FCS-1 was applied at 0.025% SOF, while in Examples 2 and 4, FCS-1 was applied at 0.10% SOF. In Examples 1 and 2, a mixture of FCT-1 and FCS-1 was sprayed over carpet prewet with water by padding, while in Examples 3 and 4, FCS-1 was applied by padding followed by spraying with FCT-1. For each of Examples 1–4, the carpet treated with the solution of FCT-1 and FCS-1 was cured for 15 minutes at 250° F. (121° C.) in a forced air oven wherein the heated air flow was directed through the carpet samples from top to bottom (resulting in faster drying than in a conventionally ventilated oven where samples have hot air blown horizontally across their top surfaces).

After oven drying, the relative soiling potential of each treatment was determined by challenging both treated and untreated (control) carpet samples under defined soiling conditions and comparing their relative soiling levels. The defined soil condition test was conducted by mounting treated and untreated carpet squares on particle board, placing the samples on the floor of a commercial location, and allowing the samples to be soiled by normal foot traffic. The amount of foot traffic in each of these areas was monitored, and the position of each sample within a given location was changed daily using a pattern designed to minimize the effects of position and orientation upon soiling.

Following a specific soil challenge period, measured in number of cycles wherein one cycle equals approximately 10,000 foot-traffics, the treated samples were removed and evenly vacuumed to remove unadhered soil particles. The amount of soil present on a given sample was determined using colorimetric measurements, making the assumption that the amount of soil on a given sample was proportional to the difference in color between the unsoiled sample and the corresponding sample after soiling. The three CIE L*a*b* color coordinates of the unsoiled and subsequently soiled samples were measured using a Minolta CR-310 Chroma Meter with a D65 illumination source. The color difference value, ΔE, was calculated using the equation shown below:

$$\Delta E=[(\Delta L^*)^2+(\Delta a^*)^2+(\Delta b^*)^2]^{1/2}$$

where:

$\Delta L^*=L^*\text{soiled}-L^*\text{unsoiled}$ $\Delta a^*=a^*\text{soiled}-a^*\text{unsoiled}$ $\Delta b^*=b^*\text{soiled}-b^*\text{unsoiled}$ ΔE values calculated from these colorometric measurements have been shown to be qualitatively in agreement with values from older, visual evaluations such as the soiling evaluation suggested by the AATCC, but possess the additional advantages of having a higher degree of precision and of being unaffected by evaluation environment or operator. Final ΔE values for each sample were calculated as an average of between five and seven replicates.

From the ΔE values, a percentage improvement in the performance of the sample above a prior art treatment chosen as a reference and the soiled untreated carpet was calculated according to the following formula:

$$\%\ \text{Improvement}=\frac{\Delta E(\text{Reference})-\Delta E(\text{Sample})}{\Delta E(\text{Untreated})-\Delta E(\text{Reference})}\times 100$$

For Examples 1–4, one cycle of walk-on testing (10,000 foot traffics) was run on the carpet samples. Table 1 presents the resulting percentage improvement value for each sample using Comparative Example C1 (FCT-1 applied with no surfactant) as the reference prior art treatment for each calculation.

Comparative Example C1

In Comparative Example C1, the same experiment was run as in Examples 1–4 except that FCT-1 was applied to the carpet at 0.14% SOF with no fluorochemical surfactant and application was by spraying over prewet carpet only. This sample was chosen as the reference to calculate the percentage improvement for all the experiments shown in Table 1. Its percentage improvement value is therefore, by definition, shown as zero.

Comparative Example C2

In Comparative Example C2, the same experiment was run as described in Examples 1–4 except that the carpet sample was untreated. Its percentage improvement value is, by definition, equal to −100 percent.

Comparative Examples C3–C6

In Comparative Examples C3–C6, the same experiment was run as described in Examples 1–4 except that carpet samples were treated with FCT-1, applied at 0.14% SOF, and HSS-1, applied at 0.025% and 0.1% SOF. In Comparative Examples C3 and C4, a mixture of FCT-1 and HSS-1 was sprayed over prewet carpet, while in Comparative Examples C5 and C6, HSS-1 was applied by padding followed by spraying with FCT-1. In Comparative Examples C3 and C5, the surfactant was incorporated at 0.025% SOF, while in Comparative Examples C4 and C6, the surfactant was incorporated at 0.10% SOF. Percentage improvement values from these soiling tests are presented in Table 1.

Comparative Examples C7–C10

In Comparative Examples C7–C10, the same experiment was run as described in Examples 1–4 except that FCS-1 was applied at 0.025% and 0.1% SOF to carpet alone without any fluorochemical treatment. In Comparative Examples C7 and C8, FCS-1 solution was sprayed over prewet carpet, while in Comparative Examples C9 and C10, FCS-1 solution was applied by padding. In Comparative Examples C7 and C9, FCS-1 solution was applied at 0.025% SOF, while in Comparative Examples C8 and C10, FCS-1 solution was applied at 0.10% SOF. Table 1 reports the percentage improvement values.

TABLE 1

| Example | FCT-1 Level | Surfactant, % | % Improvement |
|---|---|---|---|
| 1 | 0.14% | FCS-1, 0.025% | 45 |
| 2 | 0.14% | FCS-1, 0.10% | 49 |
| 3 | 0.14% | FCS-1, 0.025% | 0 |
| 4 | 0.14% | FCS-1, 0.10% | 55 |
| C1 | 0.14% | — | 0 |
| C2 | — | — | −100 |
| C3 | 0.14% | HSS-1, 0.025% | −6 |
| C4 | 0.14% | HSS-1, 0.10% | −10 |
| C5 | 0.14% | HSS-1, 0.025% | 37 |
| C6 | 0.14% | HSS-1, 0.10% | −12 |
| C7 | — | FCS-1, 0.025% | −12 |
| C8 | — | FCS-1, 0.10% | −4 |
| C9 | — | FCS-1, 0.025% | −84 |
| C10 | — | FCS-1, 0.10% | 12 |

The data of Table 1 demonstrate that the compositions of Examples 1–4, containing a mixture of a fluorochemical urethane treatment and a fluorochemical carboxylate surfactant generally showed much improved resistance to soiling compared to the composition of Comparative Example C1, which contained only a fluorochemical urethane treatment. Additionally, contrary to suggestions in the prior art that the addition of fluorinated surfactants to a fluorochemical treatment do not enhance anti-soiling properties, as described for example by Murphy in U.S. Pat. No. 5,153,046, Comparative Examples C7–C10 suggest that FCS-1 remains on the substrate after application and alone provides protection to soiling over untreated carpet. The compositions of Comparative Examples C3–C6, which contained the same fluorochemical urethane treatment as in Examples 1–4 but contained a hydrocarbon surfactant instead of a fluorochemical surfactant, generally showed poorer soil resistance. While the hydrocarbon surfactant showed improved anti-soiling performance when applied according to Comparative Example C5 at low concentration by spray and pad application, the fluorochemical surfactant of Examples 1–4 exhibited much more consistent benefit over a wide concentration range, particularly for spray application, the preferred method of application according to this invention.

Comparative Example C11

In Comparative Example C11, fluorochemical urethane treatment FCT-1 was applied by spray to dry commercial Nylon 6,6 carpet at 0.14% SOF as described in Examples 1–4, followed by curing for 10 minutes in a forced air oven set at 250° F. (121° C.), with the heated air flow being directed across the horizontal top surface of each wet sample. Walk-on testing was run for two cycles (20,000 foot traffics), four cycles (40,000 foot traffics) and six cycles (60,000 foot traffics) on the treated carpet samples. The ΔE readings measured relative to an untreated control serve as standards for comparison to the readings when fluorochemical surfactants were used (Examples 5–25). Thus, as shown in Table 2, percentage improvement values are reported as zero after completion of the two, four and six cycle walk-on tests.

Examples 5–24

In Examples 5–24, the same experiment was run as described in Comparative Example C11 except that fluorochemical surfactants and their mixtures were added at various percentages, defining the percentage surfactant used as percent surfactant solids in the treatment solution rather than as % SOF (for spray application, % in solution is typically ten times % SOF). Percent improvement in soiling values from these walk-on tests were calculated relative to Comparative Example C11 and are presented in Table 2.

Example 25

In Example 25, the same experiment was run as described in Examples 5–24 except that cationic fluorochemical surfactant FCS-5 was used and cationic fluorochemical urethane treatment FCT-2 was substituted for the analogous anionic fluorochemical urethane treatment FCT-1. The percent improvement in soiling value from this walk-on test was calculated relative to Comparative Example C11 and is presented in Table 2.

Comparative Examples C12–C16

In Comparative Examples C12–C16, the same experiment was run as described in Comparative Example C11 except that hydrocarbon surfactants HSS-1 and HSS-2 were used with FCT-1 fluorochemical urethane treatment. As with the fluorochemical surfactants, the percentage of hydrocarbon surfactant reported is the percent surfactant solids in the treatment solution rather than as % SOF. Percent improvement in soiling values from these walk-on tests were calculated relative to Comparative Example C11 and are presented in Table 2.

TABLE 2

| | Surfactant | | % Improvement after: | | |
|---|---|---|---|---|---|
| Example | Name | % (wt) | 2 Cycles | 4 Cycles | 6 Cycles |
| C11 | — | — | 0 | 0 | 0 |
| 5 | FCS-1 | 0.06 | 6 | 6 | 27 |
| 6 | FCS-1 | 0.125 | 11 | 19 | 38 |
| 7 | FCS-1 | 0.25 | 19 | 15 | 31 |
| 8 | FCS-1 | 0.5 | 8 | 10 | 36 |
| 9 | FCS-2 | 0.25 | 6 | 14 | 11 |
| 10 | FCS-2 | 0.5 | 26 | 31 | 37 |
| 11 | FCS-3 | 0.5 | 31 | 28 | 29 |
| 12 | FCS-4 | 0.25 | 26 | 29 | 15 |
| 13 | FCS-4 | 0.5 | 34 | 45 | 25 |
| 14 | FCS-6 | 0.2 | 4 | 14 | 18 |
| 15 | FCS-7 | 0.2 | 4 | 17 | 18 |
| 16 | FCS-8 | 0.2 | 32 | 34 | 35 |
| 17 | FCS-9 | 0.2 | 32 | 26 | 30 |
| 18 | FCS-10 | 0.2 | 28 | 29 | 46 |
| 19 | FCS-11 | 0.2 | −13 | 14 | 12 |
| 20 | FCS-1/FCS-2 | 0.125/0.125 | 40 | 19 | 46 |
| 21 | FCS-2/FCS-4 | 0.125/0.125 | 29 | 17 | 39 |
| 22 | FCS-1/FCS-6 | 0.1/0.1 | 36 | 34 | 57 |
| 23 | FCS-6/FCS-8 | 0.1/0.1 | 24 | 14 | 32 |
| 24 | FCS-4/HSS-2 | 0.125/0.1 | 15 | 2 | 12 |
| 25 | FCS-5 | 0.2 | 11 | 25 | 26 |
| C12 | HSS-1 | 0.005 | 9 | 0 | 12 |
| C13 | HSS-1 | 0.025 | 6 | 4 | 10 |
| C14 | HSS-2 | 0.1 | 15 | 9 | 15 |
| C15 | HSS-3 | 0.25 | −9 | 9 | 7 |
| C16 | HSS-4 | 0.25 | −33 | −9 | 0 |

The data of Table 2 demonstrate the durability of the combination of a fluorochemical treatment with a fluorochemical surfactant according to this invention. The overall performance of the fluorochemical surfactant and fluorochemical treatment combinations is generally far superior to the performance of the hydrocarbon surfactant and fluorochemical treatment combinations. The superior performance continues through six test cycles (60,000 foot traffics). The combination of HSS-2 hydrocarbon surfactant with a fluorochemical surfactant and a fluorochemical treatment also shows improved performance over the combination of a fluorochemical treatment with a hydrocarbon surfactant alone.

Comparative Example C17

In Comparative Example C17, the same experiment was run as described in Comparative Example C11 except that FCT-3, another fluorochemical urethane treatment, was substituted for FCT-1 and the treatment level for FCT-3 was 0.15% SOF. Walk-on testing was run for two cycles (20,000 foot traffics), four cycles (40,000 foot traffics) and six cycles (60,000 foot traffics) on the treated carpet samples. The ΔE readings measured relative to an untreated control serve as standards for comparison to the readings when fluorochemical surfactants were used (Examples 26–31). Thus, as shown in Table 3, percentage improvement values are reported as zero after completion of the two, four and six cycle walk-on tests.

In addition, a dynamic water repellency test was run on the treated carpet sample. In performing the test, a tared 30 cm by 15 cm carpet sample placed on a flat steel plate inclined at a 45° angle was challenged to 22 g of deionized water dropped from a height of 30 cm onto the upper portion of the carpet sample. The wet carpet was shaken three times to remove any beaded water and then was weighed to determine the weight of water (grams) absorbed. The water absorption value obtained for this comparative example serves to compare against samples treated with one or more surfactants (Examples 26–31) to calculate a percentage improvement for those samples in accordance with the formulas previously described. The percentage improvement for this comparative example is, by definition, reported as zero in Table 3.

Examples 26–30

In Examples 26–30, the same experiments were run as described in Comparative Example C17 except that fluorochemical surfactants FCS-13 to FCS-17 were added at 0.25% solids, based on treatment solution. Percent improvement in soiling values from these walk-on tests and percent improvement in dynamic water repellency values relative to Comparative Example C17 are presented in Table 3.

Example 31

In Example 31, the same experiments were run as described in Examples 26–30 except that the fluorochemical surfactant used was FCS-18, which has a hydrophobe chain length of only one carbon atom and is not significantly surface active. Percent improvement in soiling values from these walk-on tests and percent improvement in dynamic water repellency values relative to Comparative Example C17 are presented in Table 3.

Comparative Example C18

In Comparative Example C18, the same experiments were run as described in Comparative Example C17 except that FCS-19, a polymeric fluorochemical surfactant outside the scope of this invention, was added at 0.25% solids, based on the treatment solution. Percent improvement in soiling values from these walk-on tests and percent improvement in dynamic water repellency values relative to Comparative Example C17 are presented in Table 3.

Comparative Example C19

In Comparative Example C19, the same experiments were run as described in Comparative Example C17 except that HSS-5, a short chain hydrocarbon surfactant, was added at 0.25% solids, based on the treatment solution. Percent improvement in soiling values from these walk-on tests and percent improvement relative to Comparative Example C17 are presented in Table 3.

TABLE 3

| Example | Surfactant Name | Surfactant % (wt) | % Improvement after: 2 Cycles | 4 Cycles | 6 Cycles | % Improvement Dynamic Water Repellency |
|---|---|---|---|---|---|---|
| C17 | — | — | 0 | 0 | 0 | 0 |
| 26 | FCS-13 | 0.25 | 2 | 12 | 19 | — |
| 27 | FCS-14 | 0.25 | 13 | 27 | 24 | 18 |
| 28 | FCS-15 | 0.25 | 5 | 17 | 14 | 23 |
| 29 | FCS-16 | 0.25 | 13 | 30 | 24 | 16 |
| 30 | FCS-17 | 0.25 | 26 | 50 | 52 | 9 |
| 31 | FCS-18 | 0.25 | 21 | 37 | 38 | 7 |
| C18 | FCS-19 | 0.25 | −13 | 0 | 7 | 11 |
| C19 | HSS-5 | 0.25 | −14 | 0 | — | — |

The data in Table 3 again show the durability to soiling of the combination of a fluorochemical treatment with a fluorochemical surfactant according to this invention, even when the fluorochemical surfactant contains only one carbon atom in the perfluorinated chain. The data also show an improvement in dynamic water repellency with the incorporation of a fluorochemical surfactant. The overall performance of the fluorochemical surfactant and fluorochemical treatment combinations are superior to the performance of either the polymeric fluorochemical surfactant or the hydrocarbon surfactant combined with the fluorochemical treatment.

Examples 32–38

In Examples 32–38, commercially available fluorochemical treatments FCT-4 to FCT-7 were evaluated alone and in combination with 0.25% solids (based on treatment solution) of various fluorochemical surfactants, using the same spray application, cure cycle and walk-on soiling test as described in Examples 5–25. The percentage improvement values were calculated relative to reference soiling values measured using the fluorochemical treatment alone without added fluorochemical surfactant. Results are tabulated in Table 4.

TABLE 4

| Example | Treatment, % SOF | Surfactant | % Improvement After: 2 Cycles | 4 Cycles |
|---|---|---|---|---|
| 32 | FCT-4, 0.10% | FCS-1 | −3 | 0 |
| 33 | FCT-4, 0.10% | FCS-4 | 26 | 20 |
| 34 | FCT-5, 0.43% | FCS-1 | 44 | 72 |
| 35 | FCT-5, 0.43% | FCS-4 | 33 | 48 |
| 36 | FCT-6, 0.28% | FCS-5 | 88 | 60 |
| 37 | FCT-7, 0.15% | FCS-1 | 13 | 9 |
| 38 | FCT-8, 0.15% | FCS-1 | 16 | 11 |

The data in Table 4 show that incorporation of fluorochemical surfactant improves the antisoiling performance of a variety of fluorochemical treatments.

Examples 39–41 and Comparative Examples C20–C22

In Examples 39–41, fluorochemical surfactants FCS-1, FCS-4 and FCS-5 at 0.25% solids based on treatment solution were evaluated with 0.15% SOF of fluorochemical treatment FCT-3 as carpet treatments using the same spray application, cure cycle and walk-on soiling test as described in Examples 5–25. In Comparative Examples C20–C22, HCT-1 and HCT-2, non-fluorochemical (i.e., hydrocarbon) treatments described in U.S. Pat. No. 4,107,055 (Sukomick et al.) which are outside the scope of this invention, were evaluated with the same fluorochemical surfactants and the same test procedures as with Examples 39–41. Both HCT-1 and HCT-2 contain the same hydrocarbon acrylate polymer but HCT-1 contains a cationic emulsifier while HCT-2 contains an anionic emulsifier. For both Examples 39–41 and Comparative Examples C20–C22, percent improvement in soiling values were calculated relative to soiling values using FCT-3 alone (i.e., no surfactant) at 0.15% SOF as the reference value. Results are presented in Table 5.

TABLE 5

| | | | % Improvement After: | |
|---|---|---|---|---|
| Example | Treatment | Surfactant | 2 Cycles | 4 Cycles |
| 39 | FCT-3 | FCS-1 | 25 | 33 |
| 40 | FCT-3 | FCS-4 | 63 | 64 |
| 41 | FCT-3 | FCS-5 | 41 | 48 |
| C20 | HCT-2 | FCS-1 | 0 | −9 |
| C21 | HCT-2 | FCS-4 | <34 | −39 |
| C22 | HCT-1 | FCS-5 | 41 | 36 |

The data from Table 5 demonstrate that, when blended with the fluorochemical surfactant, the fluorochemical treatment generally out-performs the hydrocarbon treatment as a durable soil-resistant carpet protector.

COMPARATIVE EXAMPLE C23

In Comparative Example C23, the same experiment was run as described in Comparative Example C11 except that 90% by weight of FCT-1 was substituted for HCT-3, a hydrocarbon urethane extender. Walk-on testing was run for two cycles (20,000 foot traffics) and six cycles (60,000 foot traffics) on the treated carpet samples. Percent improvement in soiling values from these walk-on tests were calculated relative to the reference of Comparative Example C11 (FCT-1 alone) and are presented in Table 6.

Example 42

In Example 42, the same experiment was run as described in Comparative Example C23 except that fluorochemical surfactant FCS-5 was added to the hydrocarbon treatment (HCT-3) at 0.25% solids, based on treatment solution. Percent improvement in soiling values from these walk-on tests were calculated relative to the reference of Comparative Example C11 and are presented in Table 6.

TABLE 6

| | | | % Improvement After: | |
|---|---|---|---|---|
| Example | Treatment | Surfactant | 2 Cycles | 4 Cycles |
| C23 | FCT-1/HCT-3 | — | 0 | −37 |
| 42 | FCT-1/HCT-3 | FCS-5 | 6 | 12 |

The data in Table 6 show that incorporation of a fluorochemical surfactant improves the soil resistance of the treatment, overcoming the deficiency contributed by the hydrocarbon extender.

Comparative Examples C24–C26

In Comparative Examples C24–C26, fluorochemical urethane treatment FCT-3 was mixed with a methyl methacrylate/ethyl methacrylate (MMA/EMA) copolymer conventional antisoilant at a ratio of treatment to antisoilant of 2:1, 6:1 and 10:1. The MMA/EMA copolymer was made by adding to a reaction vessel 35.7 g of ethyl methacrylate (EMA), 35.7 g of methyl methacrylate (MMA), 75 g of deionized water, 10.2 g of Sermul™ Surfactant EA 151, available from Servo Chemische Sabriek, B. V., and 0.16 g of potassium persulfate. The aqueous monomer dispersion was degassed three times at reduced pressure and with a nitrogen purge and was placed in a laundrometer at 65° C. for 18 hours. The contents were then poured from the vessel into a storage jar. The resulting white, milky EMA/MMA polymer dispersion contained 52% solids.

The treatment/antisoilant blends each were spray-applied to solution dyed nylon 6 carpet having a face weight of 38 oz/yd$^2$ at 0.14% SOF based on treatment and the treated carpet samples were oven-cured as described in Comparative Example C11. Walk-on testing was run for two cycles (20,000 foot traffics). As in Comparative Example C11, the ΔE readings measured relative to an untreated control were used as standards for comparison to the readings when fluorochemical surfactants were used (Examples 43–46 infra). Thus, as shown in Table 7, percentage improvement values were reported as zero after completion of the two cycle walk-on tests.

Treated samples were also evaluated for oil repellency using 3M Oil Repellency Test III (February 1994), available from 3M Company, Saint Paul, Minn. In this test, treated carpet samples are challenged to penetration by oils or oil mixtures of varying surface tensions. Oils and oil mixtures are given a rating corresponding to the following.

| Oil Repellency Rating Number | Oil Composition |
|---|---|
| 1 | mineral oil |
| 1.5 | 85/15 (vol.) mineral oil/n-hexadecane |
| 2 | 65/35 (vol.) mineral oil/n-hexadecane |
| 3 | n-hexadecane |
| 4 | n-tetradecane |
| 5 | n-dodecane |
| 6 | n-decane |

In running this test, a treated carpet sample is placed on a flat, horizontal surface and the carpet pile is hand-brushed in the direction giving the greatest lay to the yarn. Five small drops of an oil or oil mixture are gently placed at points at least two inches apart on the carpet sample. If, after observing for 10 seconds at a 45° angle, four of the five drops are visible as a sphere or a hemisphere, the carpet is deemed to pass the test for that oil or oil mixture. The reported oil repellency rating corresponds to the most penetrating oil (i.e. the highest numbered oil in the above table) for which the treated carpet sample passes the described test.

Treated carpet samples were also evaluated for water repellency. Water repellency using 3M Water Repellency Test V for Floorcoverings (February 1994), available from 3M Company. In this test, treated carpet samples are challenged to penetration by blends of deionized water and isopropyl alcohol (IPA). Each blend is given a rating number as shown below.

| Water Repellency Rating Number | Water/IPA Blend (% vol) |
|---|---|
| 0 | 100% Water |
| 1 | 90/10 Water/IPA |
| 2 | 80/20 Water/IPA |
| 3 | 70/30 Water/IPA |
| 4 | 60/40 Water/IPA |
| 5 | 50/50 Water/IPA |
| 6 | 40/60 Water/IPA |
| 7 | 30/70 Water/IPA |
| 8 | 20/80 Water/IPA |
| 9 | 10/90 Water/IPA |
| 10 | 100% IPA |

The test is run in the same manner as the oil repellency test previously described, with the reported water repellency rating corresponding to the highest IPA-containing blend for which the treated carpet passes the test.

Examples 43–47

In Examples 43–47, the same experiments were run as in Comparative Examples C24–C26 except that 0.25% (wt) of either FCS-1 or FCS-4 fluorochemical surfactant was added to the treating solution. Percentage improvement in soil resistance after walk-on tests were calculated based on values from Comparative Examples C24–C26 without the fluorochemical surfactant and are presented in Table 7, along with measured oil and water repellency values.

TABLE 7

| | Additive to Treatment | Surfac- | Improvement after: | | Repellency | |
|---|---|---|---|---|---|---|
| Ex. | Ratio | tant | 2 Cycles | 4 Cycles | Oil | Water |
| C24 | 2:1 | — | 0 | 0 | 2 | 2 |
| 43 | 2:1 | FCS-1 | 42 | 21 | 2 | 2 |
| 44 | 2:1 | FCS-4 | 32 | 17 | 3 | 2 |
| C25 | 6:1 | — | 0 | 0 | 1.5 | 2 |
| 45 | 6:1 | FCS-1 | 62 | 30 | 2 | 2 |
| 46 | 6:1 | FCS-4 | 78 | 40 | 3 | 2 |
| C26 | 10:1 | — | 0 | 0 | 2 | 2 |
| 47 | 10:1 | FCS-1 | 31 | 14 | 2 | 2 |

The data in Table 7 show that, in every case, addition fluorochemical surfactant greatly enhances the anti-soiling performance over that shown by the combination of the fluorochemical treatment and conventional acrylic antisoilant used alone. Incorporation of fluorochemical surfactant provides improvement in oil repellency and has no adverse effect on water/IPA repellency.

Comparative Examples C27–C29

In Comparative Examples C27–C29, the same experiments were run as in Comparative Examples C24–C26 except that 3M Brand FC-661 Stain Release Concentrate (a sulfonated aromatic/formaldehyde resin blended with a hydrophilic acrylic polymer) was used in place of the MMA/EMA acrylic copolymer. Percentage improvement in soil resistance after walk-on tests were calculated based on values from Comparative Examples C27–C29 (without the fluorochemical surfactant) and are presented in Table 8, along with measured oil repellency values.

Examples 48–53

In Examples 48–53, the same experiments were run as in Comparative Examples C27–C29 except that 0.25% (wt) of either FCS-1 or FCS-4 fluorochemical surfactant was added to the treating solution. Percentage improvement in soil resistance after walk-on tests were calculated based on values from Comparative Examples C27–C29 without the fluorochemical surfactant and are presented in Table 8, along with measured oil repellency values.

TABLE 8

| | Additive to Treatment | | Improvement after: | | Oil |
|---|---|---|---|---|---|
| Ex. | Ratio | Surfactant | 2 Cycles | 4 Cycles | Repellency |
| C27 | 2:1 | — | 0 | 0 | 1 |
| 48 | 2:1 | FCS-1 | 9 | 12 | 1 |
| 49 | 2:1 | FCS-4 | 7 | 22 | 1.5 |
| C28 | 6:1 | — | 0 | 0 | 1 |
| 50 | 6:1 | FCS-1 | 11 | 10 | 0 |
| 51 | 6:1 | FCS-4 | 31 | 42 | 2 |
| C29 | 10:1 | — | 0 | 0 | 0 |
| 52 | 10:1 | FCS-1 | 6 | 4 | 0 |
| 53 | 10:1 | FCS-4 | 17 | 32 | 2 |

The data in Table 8 show that, in every case, addition of a fluorochemical surfactant enhances the anti-soiling performance over that shown by the combination of the fluorochemical treatment and conventional sulfonated aromatic/formaldehyde resin—hydrophilic acrylic polymer blend used alone. Incorporation of a fluorochemical surfactant generally provides improvement in oil repellency.

Various modifications and alterations of this invention will become apparent to those skilled in the art without departing from the scope and spirit of the present invention, and it should be understood that this invention is not to be unduly limited to the illustrative embodiments set forth hereinabove.

We claim:

1. A composition for treating fibrous substrates to render said substrates durably resistant to dry soil and durably repellent to water and oil, said composition being an aqueous emulsion comprising:

(a) a fluorochemical treatment comprising one or more fluorochemical compounds selected from the group consisting of fluorochemical urethanes, ureas, non-aromatic esters, ethers, alcohols, epoxides, allophanates, amides, amines, acids, carbodiimides, guanidines, oxazolidinones, isocyanurates, biurets, and acrylate and substituted acrylate homopolymers and copolymers;

(b) one or more fluorochemical surfactants comprising one or two fluorochemical groups and one or two water-solubilizing polar groups present in the emulsion in an amount effective to render said fibrous substrate durably resistant to dry soil and durably repellent to water and oil; and (c) one or more non-fluorinated additives selected from the group consisting of: water soluble sulfonates of succinic esters; branched and linear alcoholic ethoxylates; alkylated alkynyl diols; polyethoxylated siloxanes; acrylic and methacrylic acid polymers and copolymers; sulfonated phenol-formaldehyde resins; sulfonated novolak resins; styrene-maleic anhydride polymers; and alkyl, alkylether and alkylaryl sulfates, alkyl, alkylether and alkylaryl sulfonates and alkyl, alkylether and alkylaryl sulfonic acids.

2. The composition of claim 1 wherein the fluorochemical surfactants constitute at least 5 percent by weight of the composition relative to the weight of the fluorochemical treatment.

3. The composition of claim 1 wherein the fluorochemical surfactants constitute at least 10 percent by weight of the composition relative to the weight of the fluorochemical treatment.

4. The composition of claim 1 wherein one or more of the fluorochemical compounds is a fluorochemical urethane.

5. The composition of claim 1 wherein at least one of the fluorochemical surfactants is $C_7F_{15}CO_2^-N(C_4H_9)_4^+$.

6. A composition for treating fibrous substrates to render said substrates durably resistant to dry soil and durably repellent to water and oil, said composition being an aqueous emulsion comprising:

(a) a fluorochemical treatment comprising one or more fluorochemical compounds and one or more fluorine-free extender compounds; and (b) one or more fluorochemical surfactants comprising one or two fluorochemical groups and one or two water-solubilizing polar groups present in the emulsion in an amount effective to render said fibrous substrate durably resistant to dry soil and durably repellent to water and oil.

7. The composition of claim 6 wherein one or more of the fluorine-free extender compounds are selected from the group consisting of acrylate and substituted aerylate polymers and copolymers, siloxanes, urethanes, blocked isocyanate-containing polymers and oligomers, condensates and precondensates of urea or melamine with formaldehyde, glyoxal resins, condensates of fatty acids with melamine or urea derivatives, condensation of fatty acids with polyamides, epichlorohydrin adducts of condensation of fatty acids with polyamides, waxes, polyethylene, alkyl ketene dimers, esters, and amides.

8. The composition of claim 6 wherein the fluorinated surfactants constitute at least 5 percent by weight of the composition relative to the weight of the fluorochemical treatment.

9. The composition of claim 6 wherein the fluorinated surfactants constitute at least 10 percent by weight of the composition relative to the weight of the fluorochemical treatment.

10. The composition of claim 7 wherein the fluorinated surfactants constitute at least 5 percent by weight of the composition relative to the weight of the fluorochemical treatment.

11. The composition of claim 6 further comprising one or more non-fluorinated additives selected from the group consisting of: water soluble sulfonates of succinic esters; branched and linear alcoholic ethoxylates; alkylated alkynyl diols; polyethoxylated siloxanes; acrylic and methacrylic acid polymers and copolymers; sulfonated phenol-formaldehyde resins; sulfonated novolak resins; styrene-maleic anhydride polymers; and alkyl, alkylether and alkylaryl sulfates, alkyl, alkylether and alkylaryl sulfonates and alkyl, alkylether and alkylary sulfonic acids.

12. The composition of claim 11 wherein the fluorinated surfactants constitute at least 5 percent by weight of the composition relative to the weight of the fluorochemical treatment.

13. The composition of claim 6 wherein one or more of the fluorochemical compounds is a fluorochemical urethane.

14. The composition of claim 6 wherein at least one of the fluorochemical surfactants is $C_7F_{15}CO_2^-N(C_4H_9)_4^+$.

15. A composition for treating fibrous substrates to render said substrates durably resistant to dry soil and durably repellent to water and oil, said composition being an aqueous emulsion comprising:

(a) a fluorochemical treatment comprising one or more fluorochemical compounds selected from the group consisting of fluorochemical urethanes, ureas, non-aromatic esters, ethers, alcohols, epoxides, allophanates, amides, amines, acids, carbodiimides, guanidines, oxazolidinones, isocyanurates, and biurets;

(b) one or more ionic fluorinated surfactants comprising one or two fluorochemical groups and one or two water-solubilizing polar groups present in the emulsion in an amount effective to render said fibrous substrate durably resistant to dry soil and durably repellent to water and oil.

16. The composition of claim 15 wherein the fluorinated surfactants constitute at least 5 percent by weight of the composition relative to the weight of the fluorochemical treatment.

17. The composition of claim 15 wherein the fluorinated surfactants constitute at least 10 percent by weight of the composition relative to the weight of the fluorochemical treatment.

18. The composition of claim 15 wherein the fluorochemical treatment further comprises one or more fluorine-free extender compounds selected from the group consisting of acrylate and substituted acrylate polymers and copolymers, siloxanes, urethanes, blocked isocyanate-containing polymers and oligomers, condensates and precondensates of urea or melamine with formaldehyde, glyoxal resins, condensates of fatty acids with melamine or urea derivatives, condensation of fatty acids with polyamides, epichlorohydrin adducts of condensation of fatty acids with polyamides, waxes, polyethylene, alkyl ketene dimers, esters, and amides.

19. The composition of claim 18 wherein the fluorinated surfactants constitute at least 5 percent by weight of the composition relative to the weight of the fluorochemical treatment.

20. The composition of claim 15 further comprising one or more non-fluorinated additives selected from the group consisting of: water soluble sulfonates of succinic esters; branched and linear alcoholic ethoxylates; alkylated alkynyl diols; polyethoxylated siloxanes; acrylic and methacrylic acid polymers and copolymers; sulfonated phenol-formaldehyde resins; sulfonated novolak resins; styrene-maleic anhydride polymers; and alkyl, alkylether and alkylaryl sulfates, alkyl, alkylether and alkylaryl sulfonates and alkyl, alkylether and alkylaryl sulfonic acids.

21. The composition of claim 20 where the fluorinated surfactants constitute at least 5 percent by weight of the composition relative to the weight of the fluorochemical treatment.

22. The composition of claim 15 wherein one or more of the fluorochemical compounds is a fluorochemical urethane.

23. The composition of claim 15 wherein at least one of the fluorochemical surfactants is $C_7F_{15}CO_2^-N(C_4H_9)_4^+$.

24. A method for treating carpet, textiles, leather, and paper comprising applying to the carpet, textiles, leather, or paper a composition according to claim 1.

25. The method according to claim 24 wherein the application is performed by spray, immersion, or foam application.

26. The method according to claim 24 wherein said composition is sprayed onto dry carpet, textiles, leather or paper.

27. A method for treating carpet, textiles, leather, and paper comprising applying to the carpet, textiles, leather, or paper a composition according to claim 6.

28. The method according to claim 27 wherein said application is performed by spray, immersion, or foam application.

29. The method according to claim 29 wherein said composition is sprayed onto dry carpet, textiles, leather or paper.

30. A method for treating carpet, textiles, leather, and paper comprising applying to the carpet, textiles, leather, or paper a composition according to claim 15.

31. The method according to claim 30 wherein said application is performed by spray, immersion, or foam application.

32. The method according to claim 30 wherein said composition is sprayed onto dry carpet, textiles, leather, or paper.

33. A fibrous substrate treated with the composition of claim 1.

34. A fibrous substrate treated with the composition of claim 6.

35. A fibrous substrate treated with the composition of claim 15.

36. A composition for treating fibrous substrates to render said substrates durably resistant to dry soil and durably repellent to water and oil, said composition being an aqueous emulsion comprising:

(a) one or more fluorochemical compounds selected from the group consisting of urethanes, ureas, esters, ethers, alcohols, epoxides, allophanates, amides, amines, amine salts, acids, acid salts, carbodiimides, guanidines, oxazolidinones, isocyanurates, and biurets; and (b) one or more ionic fluorinated surfactants comprising one or two fluorochemical groups and one or two water-solubilizing polar groups present in the emulsion in an amount effective to render said fibrous substrate durably resistant to dry soil and durably repellent to water and oil.

* * * * *

UNITED STATES PATENT AND TRADEMARK OFFICE

CERTIFICATE OF CORRECTION

PATENT NO.: 5,714,082

DATED: February 3, 1998

INVENTOR(S): Gail S. Boardman et al.

It is certified that error appears in the above-identified patent and that said Letters Patent is hereby corrected as shown below:

Col. 23, line 1, "claim 29" should read -- claim 27 --.

Signed and Sealed this

Eighteenth Day of May, 1999

*Attest:*

Q. TODD DICKINSON

*Attesting Officer*

*Acting Commissioner of Patents and Trademarks*